United States Patent [19]

Norrgran et al.

[11] Patent Number: 4,597,857

[45] Date of Patent: Jul. 1, 1986

[54] PROCESS FOR PRODUCING AN UPGRADED SULFIDE MINERAL CONCENTRATE FROM AN ORE CONTAINING SULFIDE MINERAL AND SILICATE CLAY

[75] Inventors: Daniel A. Norrgran; William B. Davis, both of Tucson, Ariz.

[73] Assignee: Atlantic Richfield Company, Los Angeles, Calif.

[21] Appl. No.: 721,022

[22] Filed: Apr. 8, 1985

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS 1,842,400 1/1932 Hahn ..... 209/166

2,492,936 12/1949 Nokes et al. ..... 209/167

4,268,380 5/1981 Shaw ..... 209/167

FOREIGN PATENT DOCUMENTS 1356915 6/1974 United Kingdom ..... 209/166

*Primary Examiner*—Bernard Nozick

*Attorney, Agent, or Firm*—F. Lindsey Scott

[57] ABSTRACT

A process for separating metal sulfide minerals from an ore containing metal sulfide minerals and silicate clays by subjecting the finely divided ore to anionic flotation using an anionic collector to produce a metal sulfide mineral concentrate containing silicate clay, separating the anionic collector from the concentrate and subjecting the concentrate to cationic flotation to selectively float silicate and produce as a residual product a metal sulfide mineral concentrate containing reduced amounts of silicate clay.

16 Claims, 1 Drawing Figure

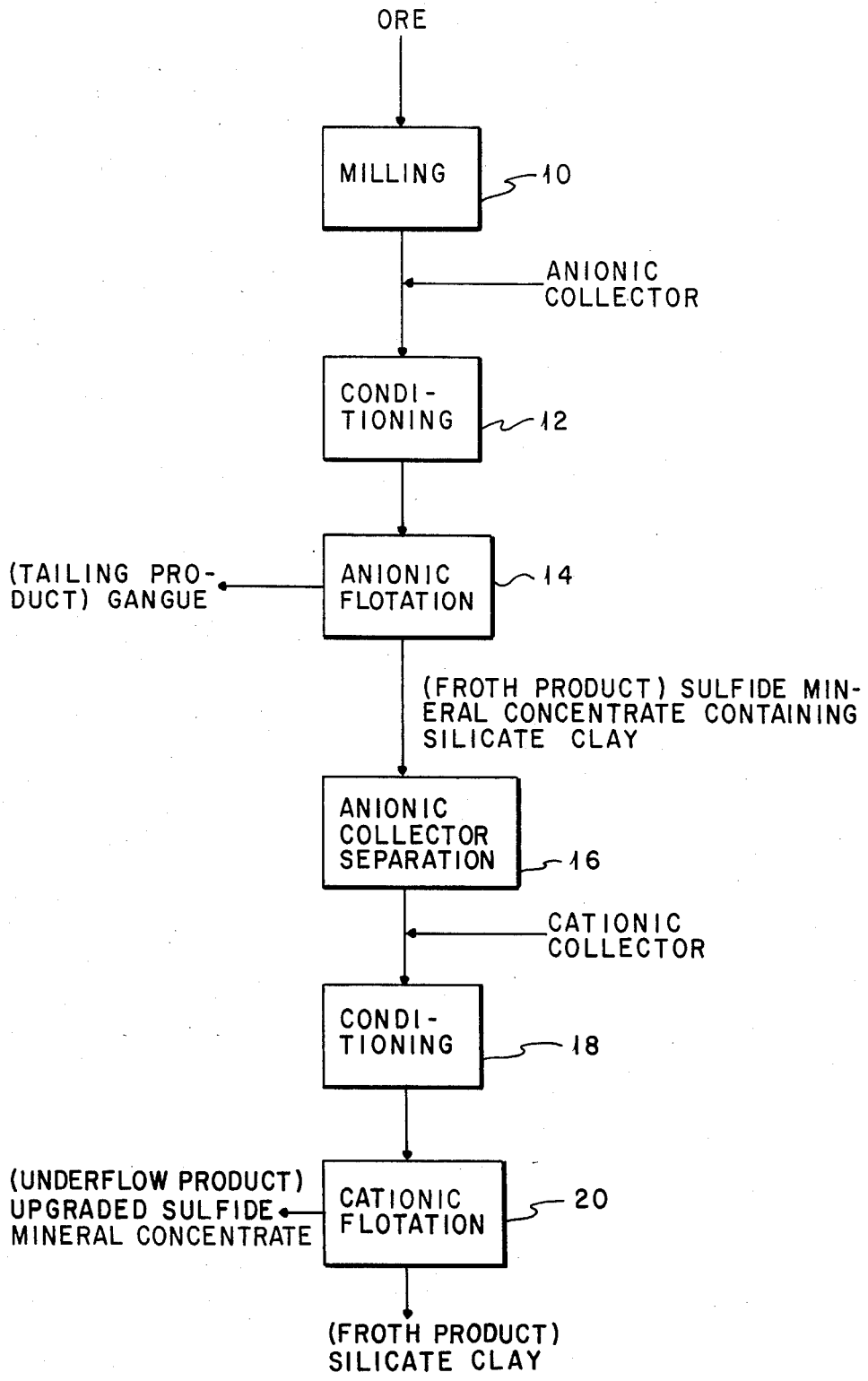
ORE
MILLING
10
ANIONIC COLLECTOR
CONDI-TIONING
12
(TAILING PRO-DUCT) GANGUE
ANIONIC FLOTATION
14
(FROTH PRODUCT) SULFIDE MIN-ERAL CONCENTRATE CONTAINING SILICATE CLAY
ANIONIC COLLECTOR SEPARATION
16
CATIONIC COLLECTOR
CONDI-TIONING
18
(UNDERFLOW PRODUCT) UPGRADED SULFIDE MINERAL CONCENTRATE
CATIONIC FLOTATION
20
(FROTH PRODUCT) SILICATE CLAY

PROCESS FOR PRODUCING AN UPGRADED SULFIDE MINERAL CONCENTRATE FROM AN ORE CONTAINING SULFIDE MINERAL AND SILICATE CLAY

This invention relates to methods for recovering sulfide minerals from the ores in which the sulfide minerals are found.

This invention further relates to the recovery of sulfide minerals by froth flotation from ores in which silicate clays are found in combination with the desired sulfide minerals.

The most common method for concentrating sulfide minerals as found in naturally occurring ores in froth flotation. In preparation for forth flotation the ore is ground to a fine particle size, usually less than about 300 microns, so that discreet sulfide mineral particles are generated. The finely divided ore is then conditioned with a reagent which selectively coats the sulfide particles and renders the mineral surfaces aerophilic. When air is then injected into the pulp, the aerophilic sulfide minerals will attach to a bubble and be carried to the surface of the pulp where they are collected as a froth. Anionic collectors such as xanthates and dithiophosphates are frequently used in the recovery of sulfide minerals in this way.

It is a common occurrence to find silicate-bearing clays associated with sulfide mineral orebodies. Many such silicate-containing clays also contain magnesium. Some common clay materials can be identified as:

chlorite $([Mg,Fe]_3[Si,Al]_4O_{10}[OH]_2.[Mg,Fe]_3[OH]_6)$ montmorillonite $([Al,Mg]_8[Si_4O_{10}]_3[OH]_{10}.12H_2O)$ talc $(Mg_3Si_4O_{10}[OH]_2)$.

These materials possess a Mohs' scale hardness of 1 to 2 and are consequently reduced to a relatively fine particle size (sub micron) during milling. These clay materials are naturally aerophilic and are collected with the sulfide concentrate. The collection of these clay materials with the sulfide minerals concentrate is undesirable. One major disadvantage is that the clays dilute the valuable mineral content of the concentrate and are refractory to pyrometallurgical treatments (smelting) which not only results in an added treatment expense but also in a loss in recovery. Further, if the sulfide mineral concentrates are to be transported for any significant distance the added transportation costs as a result of the weight of the silicate clays included in the sulfide mineral concentrate can result in substantially increased transportation costs.

Accordingly, a continuing effort has been directed to the development of methods for separating sulfide minerals from ores which contain the sulfide minerals in combination with silicate clays.

According to the present invention, it has been found that an upgraded sulfide mineral concentrate can be produced from an ore containing sulfide mineral in combination with silicate clay by a process comprising:

(a) Finely dividing the ore;

(b) Subjecting the finely dividing ore to anionic froth flotation using a suitable anionic collector to produce as a floated product a sulfide mineral concentrate, containing at least a major portion of the sulfide mineral in the ore and silicate clay, and a tailing product containing at least a major portion of the gangues in the ore;

(c) Separating the anionic collector from the sulfide mineral concentrate; and, (d) Subjecting the sulfide mineral concentrate to cationic froth flotation using a suitable cationic collector to selectively float and separate at least a major portion of the silicate clay to produce as a residual product an upgraded sulfide mineral concentrate.

FIG. 1 is a schematic diagram of an embodiment of the process of the present invention.

Ore containing sulfide minerals and silicate clays is charged to a milling zone 10 where it is finally divided by means known to those skilled in the art to produce a finely divided ore which is charged to a conditioning zone 12. In conditioning zone 12 the finely divided ore is mixed with an anionic collector, water, and a suitable alcohol-based frothing agent, such as methylisobutylcarbinol (MIBC), or other suitable frothing agents known to the art to produce a mixture suitable for anionic froth flotation. The resulting mixture is charged to an anionic flotation zone 14 where the mixture is subjected to froth flotation by means known to those skilled in the art to produce a tailing product comprising at least a major portion of the gangues in the ore. Typically, the gangue stream will comprise up to and in some instances more than 90 weight percent of the total weight of the ore charged to the process. A sulfide mineral concentrate containing silicate clay is recovered as the floated product from anionic flotation zone 14. As discussed previously, such silicate clays are naturally aerophilic and float with the desired sulfide minerals. As discussed previously, many disadvantages result from the presence of the silicate clays in the sulfide mineral concentrate. In the anionic flotation process, suitable anionic collectors are reagents such as xanthates, dithiophosphates, and the like as known to those skilled in the art. Similarly, frothing agents known to those skilled in the art can be used. As indicated previously, such anionic flotation processes have been commonly used for the recovery of sulfide mineral concentrates from ore. Unfortunately as discussed previously, silicate clays are in many instances recovered with the sulfide mineral concentrate to the detriment of subsequent processing steps.

By the process of the present invention, the sulfide mineral concentrate is passed to an anionic collector separation zone 16 where the anionic collector is separated from the sulfide mineral concentrate containing silicate clay. The anionic collector may be separated by removal, decomposition or the like as required to render the anionic collector inactive. The sulfide mineral concentrate may be steamed at a temperature and for a time sufficient to remove the anionic collector. The time and temperature selected can vary widely and any time and temperature suitable to effectively remove a quantity of the anionic collector sufficient to permit the cationic flotation process described hereinafter is sufficient. The effectiveness of the steam treatment can be determined by an evaluation of the separation obtained in the subsequent cationic flotation zone.

Similarly, the anionic collector can be removed by contacting the sulfide mineral concentrate containing silicate clay with a suitable solvent such as acetone or the like to remove the anionic collector. In such a process, the anionic collector is removed by intimately contacting the sulfide mineral concentrate with the solvent and thereafter separating the solvent from the sulfide mineral concentrate with subsequent washing and the like as required. The effectiveness of the solvent extraction can also be evaluated by an evaluation of the results of the subsequent cationic flotation process.

The anionic collector can also be removed by heating the sulfide mineral concentrate containing silicate clays to high temperatures to decompose the anionic collector. The sufficiency of the heating temperature and time can be determined by evaluation of the results in the cationic flotation process. Any of the previously described methods can be used for the separation of the anionic collector from the sulfide mineral concentrate containing silicate clay. The sulfide mineral concentrate from which the anionic collector has been removed is then passed to a conditioning zone 18 where it is mixed with water and the pH is adjusted to a value from about 9.0 to about 11.0. A cationic collector, a suitable frothing agent such as MIBC or the like and optionally a sulfide mineral depressant such as sodium cyanide in amounts up to about 0.1 pounds per ton of dry concentrate are than added to produce a mixture suitable for cationic froth flotation. The resulting mixture is then passed to a cationic flotation zone 20 where the mixture is separated into an underflow product comprising an upgraded sulfide mineral concentrate having a greatly reduced silicate clay content and a froth product comprising at least a major portion of the silicate clay contained in the mixture charged to cationic flotation zone 20.

Conditioning zone 12 may be eliminated in some instances with the collector, frothing agent and water being mixed in the flotation vessel. Such variations are within the skill of those in the art. The primary function of conditioning vessel 12 is the preparation of the mixture for anionic froth flotation. In the event that this mixture is more conveniently prepared in the froth flotation zone, such is considered to be within the scope of the present invention.

Similarly in conditioning zone 18, water is added to the sulfide mineral concentrate containing silicate clay, the pH is adjusted and cationic collector and other materials as required in cationic flotation zone 20 are added. Other such materials may comprise a suitable frothing agent such as methyliosbutylcarbinol or the like and alkaline materials, such as sodium hydroxide and the like, to adjust the pH to a desired level. As with conditioning zone 12, if preferred, the flotation mixture may be prepared in flotation zone 20. The present invention is not considered to be dependent upon the particular method chosen for the preparation of the mixtures charged to the flotation zones.

EXAMPLE

An anionic sulfide flotation concentrate containing magnesium-silicate clays was produced as is depicted in FIG. 1. This concentrate represented a third flotation stage concentrate and is considered to represent an optimum upgrading by the anionic flotation process. The concentrate was filtered and placed in a muffle furnace at 400° F. for two hours to decompose the anionic xanthate collector. After the heat treatment, the concentrate was again subjected to a flotation stage employing an amine collector at a pH of 10.5 to remove the magnesium-silicate clays. A small amount (0.05 lb per ton of dry feed) of sodium cyanide was added to the flotation pulp to prevent random activation of the sulfide minerals. The silicate-laden froth was then collected by aeration.

The test results are shown in Table 1. The first product is the anionic flotation concentrate and represents the feed to the cationic flotation stage. The second product is the cationic flotation cell concentrate containing the sulfide minerals and represents the final upgraded concentrate. The third product is the cationic flotation froth product and is predominantly non-sulfide gangue minerals (silicate clays). As is shown in Table 1, 78.9 percent of the magnesium and 92.7 percent of the silica in the initial sulfide concentrate has been rejected in the cationic flotation stage with minor losses in precious metals. These test results demonstrate that the cationic flotation process has significantly upgraded the precious metal sulfide concentrate through rejection of silicate gangue.

TABLE 1

RESULTS OF CATIONIC SILICATE FLOTATION PROCESS

| | Percent Distribution | | | | | | | | | | |
|---|---|---|---|---|---|---|---|---|---|---|---|
| Product | Weight | Pt | Pd | Au | Cu | Ni | Fe | S | MgO | $Al_2O_3$ | $SiO_2$ |
| Anionic Flotation Concentrate (Feed) | 100.0 | 100.0 | 100.0 | 100.0 | 100.0 | 100.0 | 100.0 | 100.0 | 100.0 | 100.0 | 100.0 |
| Cationic Flotation Cell Concentrate | 30.6 | 95.8 | 95.9 | 87.2 | 87.5 | 90.8 | 73.7 | 95.2 | 21.1 | 24.9 | 7.3 |
| Cationic Flotation Froth | 69.4 | 4.2 | 4.1 | 12.8 | 12.5 | 9.2 | 26.3 | 4.8 | 78.9 | 75.1 | 92.7 |

The process of the present invention is considered applicable to essentially all sulfide mineral concentrates which contain silicate gangue.

Having thus described the present invention by reference to its preferred embodiments, it is respectfully pointed out that the embodiments described are illustrative rather than limiting in nature and that many variations and modifications are possible within the scope of the present invention. Many such variations and modifications may be considered obvious and desirable to those skilled in the art based upon a review of the foregoing description of preferred embodiments and examples.

Having thus described the invention, we claim:

1. In a process for separating metal sulfide minerals from an ore containing said metal sulfide minerals and silicate clay by finely dividing said ore and subjecting said finely divided ore to anionic froth flotation using a suitable anionic collector to produce as a floated product a metal sulfide mineral concentrate containing a least a major portion of said metal sulfide minerals in said ore and silicate clay and a tailing product containing at least a major portion of the gangues of said ore, an improvement comprising: separating said anionic collector from said metal sulfide mineral concentrate and thereafter subjecting said metal sulfide mineral concentrate to cationic froth flotation using a suitable cationic collector to selectively float and separate at least a major portion of said silicate clay to produce as a residual product an upgraded metal sulfide mineral concentrate.

2. The improvement of claim 1 wherein said anionic collector is selected from the group consisting of xanthates and dithiophosphates.

3. The improvement of claim 1 wherein said silicate clay comprises a magnesium-silicate clay.

4. The improvement of claim 1 wherein said collector is inactivated by steaming said metal sulfide mineral concentrate.

5. The improvement of claim 1 wherein said anionic collector is inactivated by heating said metal sulfide mineral concentrate to a temperature for a time sufficient to inactivate said anionic collector.

6. The improvement of claim 1 wherein said anionic collector is removed from said metal sulfide mineral concentrate by intimately contacting said metal sulfide mineral concentrate with a suitable solvent.

7. The improvement of claim 1 wherein said cationic collector is an amine collector.

8. The improvement of claim 7 wherein said cationic flotation is performed at a pH from about 9.0 to about 11.0.

9. A process for producing an upgraded metal sulfide mineral concentrate from an ore containing said metal sulfide mineral and silicate clay said method comprising;

(a) Finely dividing said ore;

(b) Subjecting said finely divided ore to anionic froth flotation using a suitable anionic collector to produce as a floated product a metal sulfide mineral concentrate containing at least a major portion of said metal sulfide mineral in said ore and silicate clay and a tailing product containing at least a major portion of the gangues in said ore;

(c) Separating said anionic collector from said metal sulfide mineral concentrate; and (d) Subjecting said metal sulfide mineral concentrate to cationic froth flotation using a suitable cationic collector to selectively float and separate at least a major portion of said silicate clay to produce as a residual product an upgraded metal sulfide mineral concentrate.

10. The process of claim 9 wherein said anionic collector is selected from the group consisting of xanthates and dithiophosphates.

11. The process of claim 9 wherein said silicate clay comprises a magnesium-silicate clay.

12. The process of claim 9 wherein said anionic collector is inactivated by steaming said sulfide mineral concentrate.

13. The process of claim 9 wherein said anionic collector is inactivated by heating said metal sulfide mineral concentrate to a temperature sufficient to inactivate said anionic collector.

14. The process of claim 9 wherein said anionic collector is removed from said metal sulfide mineral concentrate by intimately contacting said metal sulfide mineral concentrate with a suitable solvent.

15. The process of claim 9 wherein said cationic collector is an amine collector.

16. The process of claim 15 wherein said cationic flotation is performed at a pH from about 9.0 to about 11.0.

* * * * *